United States Patent [19]

Horiuchi et al.

[11] Patent Number: 4,957,455

[45] Date of Patent: Sep. 18, 1990

[54] SOCKET FOR WEDGE-BASE LAMP

[75] Inventors: Kazuya Horiuchi, Mie; Kihachiro Uchida, Shizuoka; Tadashi Harada, Shizuoka; Takeshi Izawa, Shizuoka, all of Japan

[73] Assignees: Sumitomo Wiring Systems, Limited, Mie; Koito Manufacturing Co., Ltd., Tokyo, both of Japan

[21] Appl. No.: 340,613

[22] Filed: Apr. 18, 1989

[30] Foreign Application Priority Data

Apr. 19, 1988 [JP] Japan ..... 63-53321[U]
Dec. 16, 1988 [JP] Japan ..... 63-162366[U]

[51] Int. Cl.[5] ..... H01R 13/73

[52] U.S. Cl. ..... 439/548; 439/546; 439/558; 439/699

[58] Field of Search ..... 439/619, 699, 734, 280, 439/336, 356, 360, 375, 667, 546, 548, 558

[56] References Cited

U.S. PATENT DOCUMENTS

| | | | |
|---|---|---|---|
| 3,017,599 | 1/1962 | Loesch | 439/699 |
| 3,417,367 | 12/1968 | Dayton et al. | 439/619 |
| 4,181,390 | 1/1980 | Aizawa | 439/699 |
| 4,630,880 | 12/1986 | Durand | 439/699 |
| 4,752,241 | 6/1988 | Matsuoka et al. | 439/619 |

*Primary Examiner*—David L. Pirlot
*Attorney, Agent, or Firm*—Sughrue, Mion, Zinn, Macpeak & Seas

[57] ABSTRACT

A connector socket for a wedge-base lamp is improved by socket structures which aid in leading the base end of the bulb into alignment with the insertion channel and at the same time prevent contact between the base end and the top ends of the socket terminals in a way which might lead to wrenching or deformation of the terminals.

9 Claims, 9 Drawing Sheets

SOCKET FOR WEDGE-BASE LAMP

BACKGROUND OF THE INVENTION

The present invention relates to a socket for a wedge-base lamp (a capless lamp) for use in lighting equipment for automotive use or the like.

FIGS. 13 through 15 show a conventional lamp socket of the present type, in which FIG. 13 is a plan view of the lamp socket, FIG. 14 is a vertical sectional view of the main portion of the same, and FIG. 15 is a partially cutaway perspective view of the main portion.

As shown in those drawings, the conventional lamp socket has a structure in which a lamp insertion channel 4 substantially I-shaped in the plan view is formed in a substantially cylindrical lamp socket body 2, and terminals 7 each having a pair of opposed contacting and sandwiching members 6 are provided parallel to each other in the lamp insertion channel 4. A base portion 9 of a wedge-base lamp 8 inserted into the lamp insertion channel 4 is clamped by the pairs of opposed contacting and sandwiching members 6 and electrical contact is obtained between each terminal 7 and the base portion 9.

In the prior construction described above, top end portions 6*a* of the opposed contacting and sandwiching members 6 are vertically higher than upper end portions 3*a* of the opposed vertical walls 3 forming the lamp insertion channel 4. There has therefore been a problem in the following point: That is, when a wedge-base lamp 8 is inserted into the socket, if the lamp 8 is slantingly inserted as shown by arrow A14 in FIG. 4, or if the lamp 8 is inserted in a state offset from the axial center as shown by arrow A2, the base portion 9 of the lamp interferes with the top end portions 6*a* to thereby wrench and deform these portions, such that the lamp 8 cannot be smoothly inserted into the socket.

SUMMARY OF THE INVENTION

The present invention has been achieved in order to solve this problem in the prior art, and an object thereof is to provide a wedge-base lamp socket in which even if the lamp base portion is inserted slantingly or shifted from the axial center, the wedge-base lamp can always be inserted smoothly into the socket with no possibility of the contacting and sandwiching members of the terminal being wrenched and deformed, such that the elasticity of the contacting and sandwiching members of the terminals can be maintained over time.

In order to achieve the objects described above, according to one aspect of the present invention, the socket terminals are mounted inside a lamp insertion channel of a socket body, and the contacting and sandwiching portions of the opposed contacting and sandwiching members are bent so as to project inwards and so as to be increasingly separated toward the top ends thereof. Walls for leading the base portion of the inserted lamp between the opposed contacting and sandwiching members are formed obliquely behind the contacting and sandwiching members so as to project vertically higher than the top end portions of the contacting and sandwiching members. The top end portion of each of the contacting and sandwiching members is bent back to the outside position of a base-portion insertion path narrowed by the walls.

According to the present invention, the walls are formed obliquely behind the contacting and sandwiching members so as to narrow the insertion path of the lamp base portion on the lamp insertion channel side, and so as to guide the base portion of the lamp between the opposed contacting and sandwiching members. Further, since the top end portions of the contacting and sandwiching members are located outside the base portion insertion path narrowed by the walls, the inserted base portion and the respective top end portions of the contacting and sandwiching member do not interfere with each other. A further wedge-base lamp socket according to the present invention is characterized in that terminals, each provided with contacting and sandwiching members for sandwiching a base portion of a lamp therebetween and for making electrical contact with the base portion, are mounted inside a lamp insertion channel of a socket body, and in that walls are formed behind the contacting and sandwiching members so as to project vertically higher than respective top end portions of the contacting and sandwiching portions, or in that in addition to the above features, deformation preventing walls are formed so as to project vertically at side positions of the top end portions of the contacting and sandwiching members.

DESCRIPTION OF THE PREFERRED EMBODIMENTS

Figure 1:
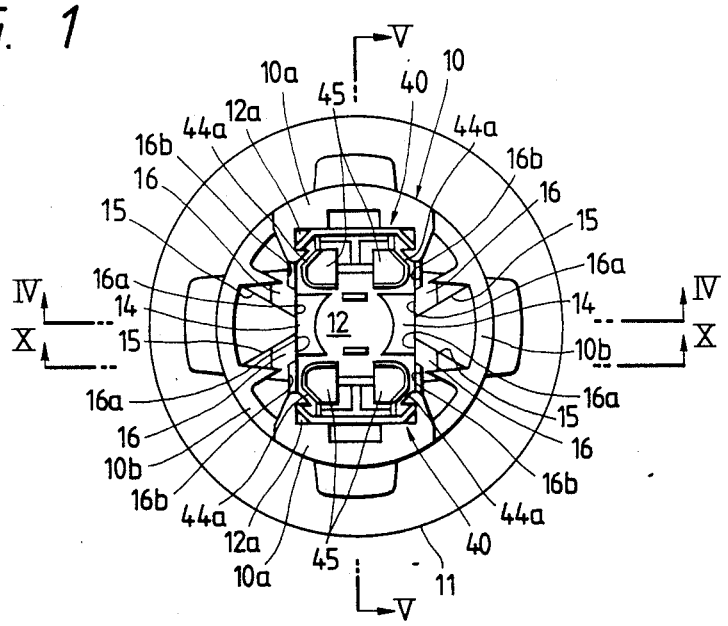
FIG. 1 is a front view of a first embodiment of the wedge-base lamp according to the present invention.
Figure 2:
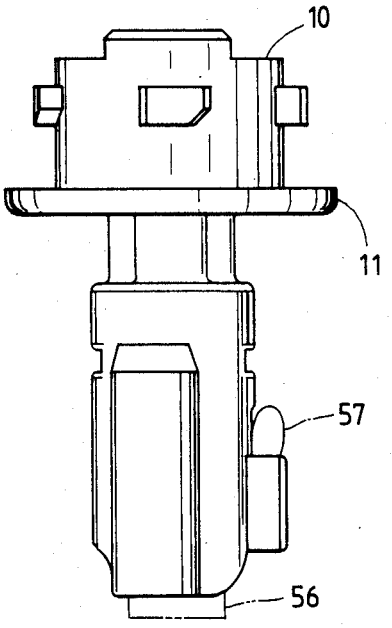
FIG. 2 is a front view of the same.
Figure 3:
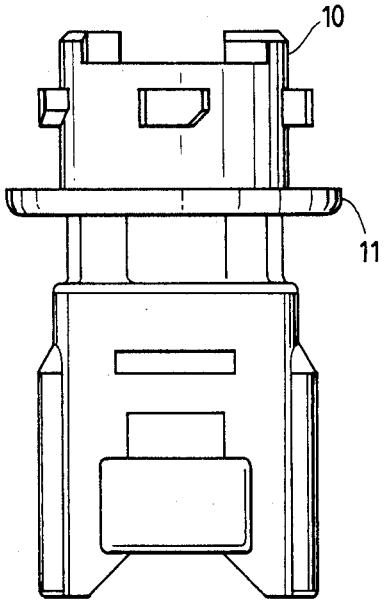
FIG. 3 is a right side view of the same.

Referring to the drawings, embodiments of the present invention will be described hereunder.

FIGS. 1 through 11 show a first embodiment of the present invention.

In these drawings, reference numeral 10 designates a lamp socket body (hereinafter simply referred to a socket body) made of an insulating material such as synthetic resin or the like and formed in a substantially cylindrical shape. A disc-like flange 11 is formed on the outer circumference of the socket body 10. A lamp insertion channel 12 for inserting and supporting a base portion 52 of a wedge-base lamp 50 (see FIG. 8) is formed in one end opening portion of the socket body 10, while a connector insertion channel 13 for inserting and supporting a connector 56 (see FIGS. 2 and 4) is formed in the other end opening portion of the socket body 10.

Figure 8:
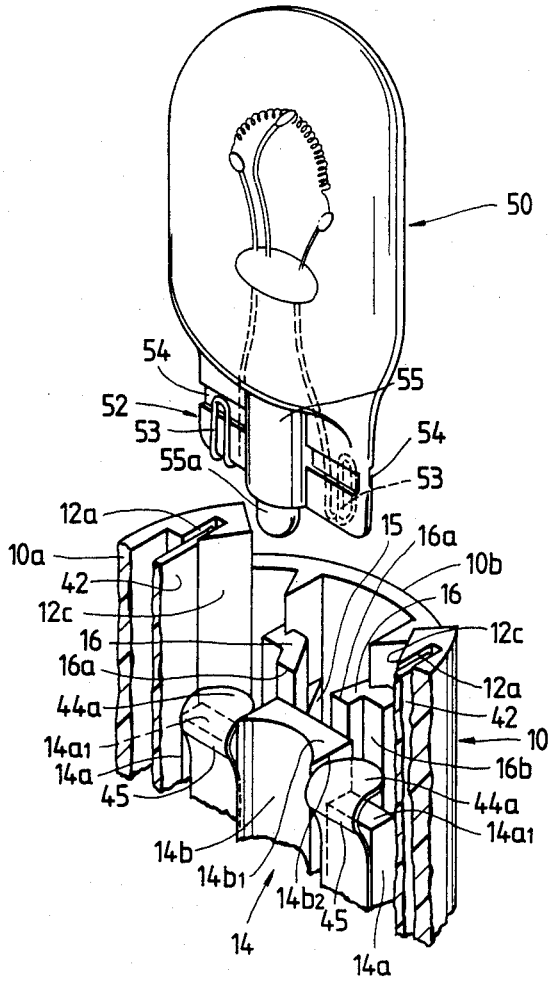
FIG. 8 and 9 are perspective partially broken away views showing the contacting and sandwiching members of the terminal.
Figure 9:
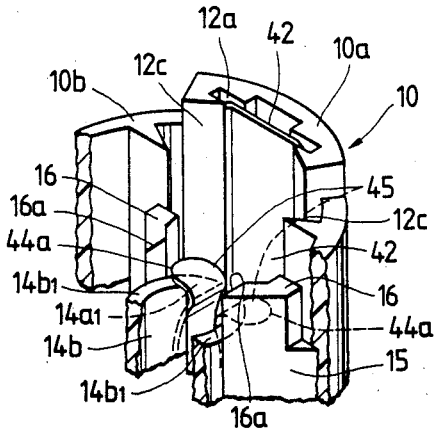

The lamp insertion channel 12 is a recess portion of substantially I-shape in plan and surrounded by opposed vertical walls 14 and 14 and socket-body forming walls 10*a*. Two terminals (a plus terminal and an earth terminal) 40 each having a pair of opposed contacting and sandwiching members 44 and 44 are oppositely provided inside the lamp insertion channel 12. Lead wires 53 of the lamp exit from the bottom of the lamp and are bent around toward narrow portions 54 formed in the base portion 52, as shown in FIG. 8. Accordingly, when the lamp 50 is inserted into the lamp insertion channel 12, each of the narrow portions 54 is clamped by a pair of contacting and sandwiching portions 45 of the opposed contacting and sandwiching members 44, so that the lamp 50 is prevented from falling out. The lead wires 53 and the contacting and sandwiching members 44 are electrically contacted with each other In FIG. 8, reference numeral 55 designates a cylindrical post portion provided at the center of the base portion, and 55*a* is a spherical protrusion projected from the lower end of the post portion 55.

Figure 6:
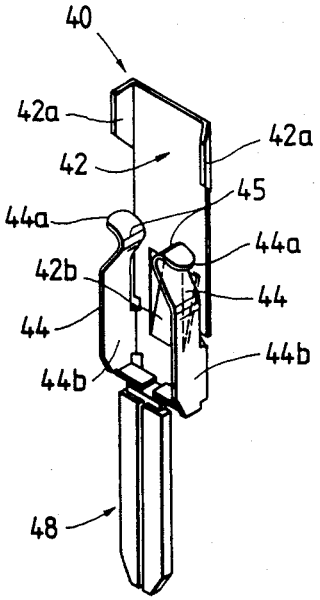
FIG. 6 is a perspective view of a terminal to be mounted in the socket body.

As shown in FIG. 6, each of the terminals 40 is constituted mainly by a flat rectangular attachment-portion area 42, the opposed contacting and sandwiching members 44 formed respectively at left and right side edge portions of the attachment portion area 42, and a belt-like connector-side contact portion 48 formed under the attachment-portion area 42.

Each of the attachment-portion area 42 of the terminal 40 fits in attachment grooves 12*a* formed in the socket-body forming wall 10*a*. Bent portions 42*a* are formed at left and right side edge portions of the upper portion of each of the attachment-portion areas 42. The bent portions 42*a* serve the function of positioning members in the front and back directions of the terminal (the vertical directions in FIG. 1, and the horizontal directions in FIG. 5). A projecting portion 42*b* is formed on each of the attachment-portion areas 42 at its substantially center portion by partially cutting and bending the portion backward. The backward projecting portion 42*b* is engaged with a stage portion 12*b* (see FIG. 5) formed on the socket-body forming wall 10*a* so as to act as a locking mechanism.

The contacting and sandwiching members 44 are made to be perpendicular to the attachment-portion area 42 and to extend up along the attachment-portion area 42. The respective top end areas of the opposed contacting and sandwiching members 44 are bent so as to project inwardly (in the direction such that the respective top end areas approach each other) and then outwardly (in the direction in which the respective top end areas become more separated from each other) as they approach the respective top ends. The respective bent portions of the members 44 form the contacting and sandwiching portions 45 which act as spring members against the base portion 52 of the inserted lamp 50 so as to sandwich the narrow portions 54 of the base portion 52 therebetween. Top end portions 44*a* of the opposed contacting and sandwiching members 44 are extended along upper end surfaces $14a_1$ (see FIGS. 8 and 9) of vertical-wall areas 14*a* facing the terminal housing portion respectively and are bent back to positions where the top end portions 44*a* do not interfere with the base portions 52 of the inserted lamp. As shown in FIG. 6, the top end portions 44*a* of the contacting and sandwiching members 44 are bent to positions where they protrude a little outside the flat plate portion areas 44*b* of the contacting and sandwiching members 44.

Figure 4:
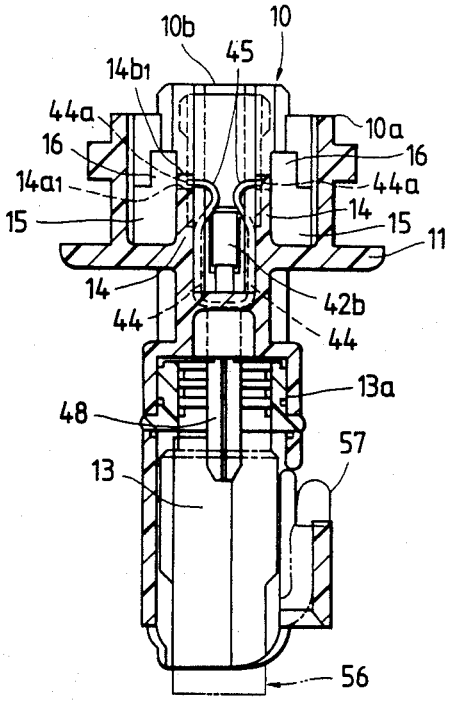
FIG. 4 is a sectional view taken on line IV—IV shown in FIG. 1.
Figure 5:
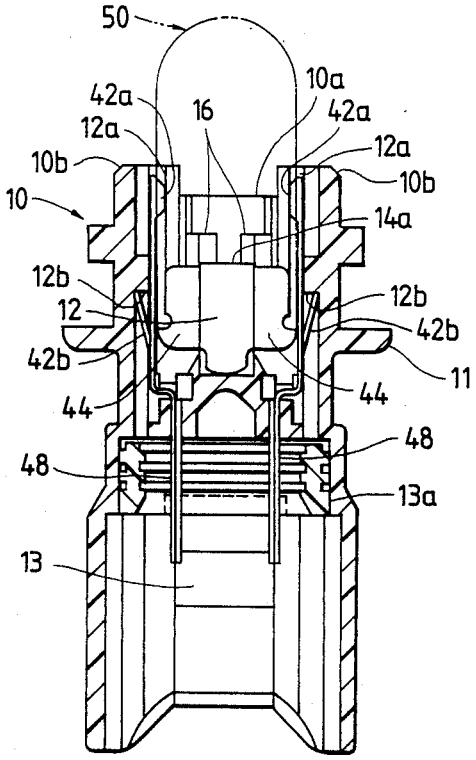
FIG. 5 is a sectional view taken on line V—V shown in FIG. 1.

As shown in FIGS. 4 and 5, the respective connector-side contact portions 48 of the terminals 40 are projected into the connector insertion channel 13 so as to be in electrical contact with terminals of the connector 56 inserted into the connector insertion channel. Reference numeral 13*a* designates a rubber packing and 57 designates a hook portion formed on the connector 56 so as to project therefrom.

Figure 7:
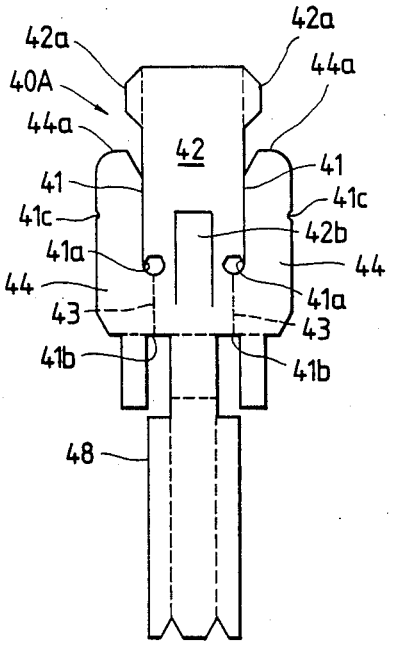
FIG. 7 is a development of the terminal.

Each of the terminals 40 is formed in the shape shown in FIG. 6 by cutting a sheet of electrically conductive metal plate material 40*A* (FIG. 7) along the solid line and then bending at positions shown by broken lines. In FIG. 7, the reference numerals 41 designate the cut lines, and 41*a*, 41*b*, and 41*c* designate notches for facilitating the bending of the contacting and sandwiching members 44.

Particularly, the contacting and sandwiching members 44 are formed by partially cutting and bending the portions of the sheet of metal plate material so as to oppose to each other and so as to be perpendicular to the attachment-portion areas 42 respectively, and the contacting and sandwiching portions 45 are then curved arcuately, so that the base portion 52 of the lamp 50 can be easily led between opposed members 44 along the bent surfaces 45. Accordingly, the lamp 50 can be smoothly inserted Substantially radially extending ribs 15 (see FIG. 1) are formed between the opposed vertical walls 14 forming the lamp insertion channel 12 and socket-body forming walls 10*b* opposed to the vertical walls 14, respectively. Upwardly projecting walls 16 are formed on the ribs 15 obliquely behind the contacting and sandwiching members 44. The walls 16 have substantially L-shaped horizontal cross sections, and are extended from back positions of the vertical wall areas 14*a* facing the terminal housing portion to vertical-wall central-portion areas 14*b* forming the portion for housing the cylindrical post portion 55 of the lamp base portion. The walls 16 are made higher than at least the top end portions 44*a* of the contacting and sandwiching members 44, and are high enough to cause the base portion 52 of a slantingly inserted lamp to abut against the inside corner portions 16*a* (see FIGS. 8 and 10) without interfering with the top end portions 44*a* of the contacting and sandwiching members 44.

Figure 10:
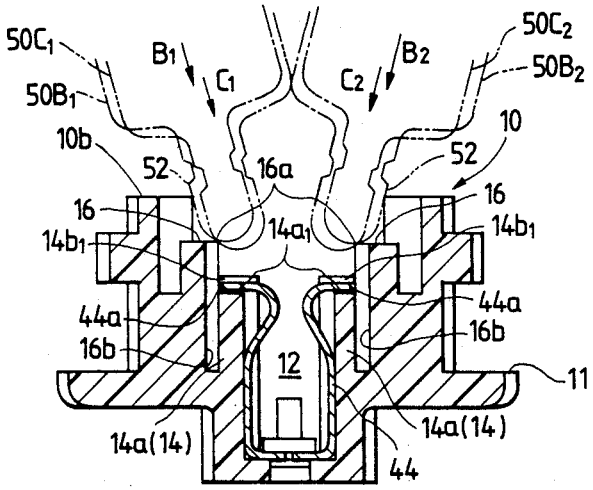
FIG. 10 is an enlarged sectional view taken on line X—X shown in FIG. 1, for explaining the operation of the walls for narrowing the lamp insertion path.

As shown in FIG. 10, the direction of insertion of the base portion 52 of the lamp is within a range between the arrows $B_1$–$B_2$, in which the socket-body forming wall 10*b* is not obstructive, in the conventional arrangement in which the walls 16 are not formed. On the other hand, in the invention wherein the walls 16 are provided, the direction of insertion of the base portion 52 is within a range between the arrows $C_1$–$C_2$. In FIG. 10, reference numerals 50$B_2$, 50$B_2$, 50$C_1$, and 50$C_2$ designate lamp positions corresponding to the base-portion insertion directions $B_1$, $B_2$, $C_1$, and $C_2$ respectively. That is, the insertion path of the base portion 52 is narrowed toward the lamp insertion channel 12 by a degree corresponding to the projection quantity of the walls 16, so that, correspondingly, the base portion 52 does not interfere with the top end portions 44*a* of the contacting and sandwiching members 44. Further, the top end portions 44*a* are bent to the vicinity of the walls 16, further preventing base portion interference with the top end portions 44*a*.

The bent top end portions 44*a* are extended along the upper end surfaces 14*a*$_1$ of the vertical-wall areas 14*a* facing the terminal housing portion, and the upper end surfaces 14*a*$_1$ are formed so as to be lower than upper end surfaces 14*b*$_1$ of the vertical-wall central-portion areas 14*b* as shown in FIGS. 8 and 10. That is, the upper end surfaces 14*b*$_1$ are higher than the top end portions 44*a*. Accordingly, the base portion 52 of the lamp can abut against the vertical-wall central-portion area upper end portions 14*b*$_1$ but not against the top end portions 44*a*. The base portion 52 and the top end portions 44*a* of the contacting and sandwiching members 44 thus never interfere with each other not only in the case where the lamp 50 is slantingly inserted but also in the case where the lamp 50 is inserted in the state shifted from the axial center L as shown by arrow $C_3$ in FIG. 11. Accordingly, the contacting and sandwiching members are never wrenched and deformed by the base portion as in the prior art.

Each of the contacting and sandwiching member top end portions 44*a* is sandwiched at its opposite sides by a vertical rib 12*c* forming the attachment groove 12*a* and a deformation preventing wall surface 14*b*$_2$ which is a side wall of the vertical-wall central portion area 14*b*, so that movement in the transverse direction (the vertical direction in FIG. 1, and the transverse direction in FIG. 8) is restricted.

In the case where the members 44 are excessively opened when a lamp is inserted, the top end portions 44*a* are made to abut against side surfaces 16*b* of the walls 16 (see, FIGS. 8 and 10), and therefore the walls 16 have the function of preventing the contacting and sandwiching members from excessive opening.

Figure 11:
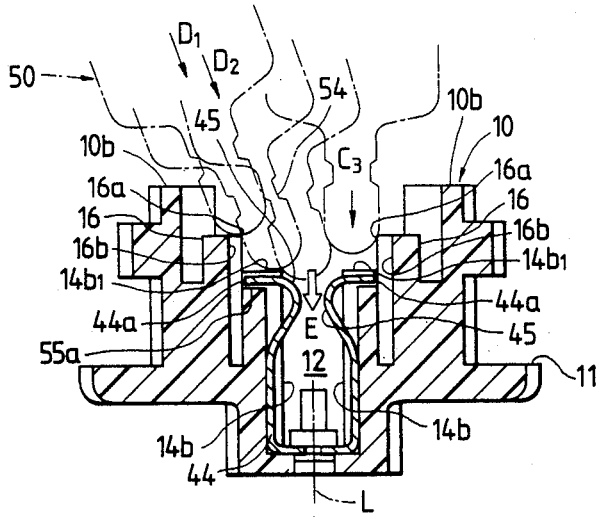
FIG. 11 is a view explaining how a lamp base portion is led between the opposed contacting and sandwiching members.

Referring to FIG. 11, the state in which the base portion 52 of the lamp 50 is led into the lamp insertion channel 12 will be described hereunder.

First, the base portion 52 of a lamp inserted in the direction shown by an arrow $D_1$ abuts on the inside corner portions 16*a* of the walls 16 and slides to the inside, so that the inserting direction is corrected to the direction shown by arrow $D_2$. Then, the cylindrical post portion 55 of the base portion 52 abuts on one of the central-portion area upper end surfaces 14*b*$_1$ of the vertical walls 14, so that the base portion 52 slides to the inside without touching the top end portions 44*a* of the contacting and sandwiching members 44. Then, the lower-end spherical protrusion 55*a* of the base portion 52 enters between the vertical wall central-portion areas 14*b* and 14*b*. At that time, as shown by an arrow E, the base portion 52 is moved between the contacting and sandwiching portions 45 and 45 while pressing the opposed contacting and sandwiching portions 45 and 45 so as to separate one from the other. Accordingly, the contacting and sandwiching portions 45 are engaged with the narrow portions 54 to thereby prevent the lamp 50 from falling out.

Figure 12:
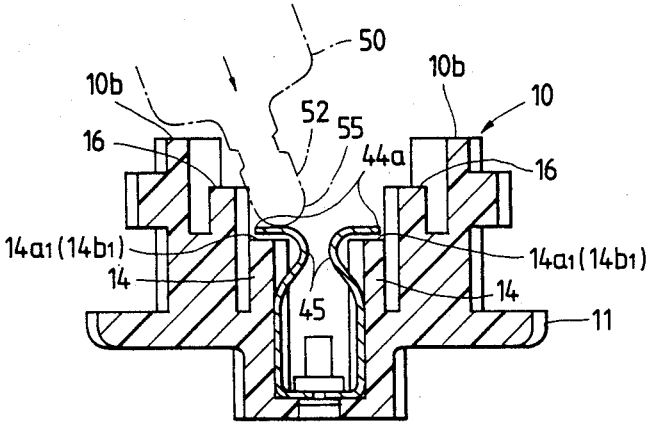
FIG. 12 is an enlarged sectional view of a main portion of another embodiment of the wedge-base lamp socket according to the present invention.
Figure 13:
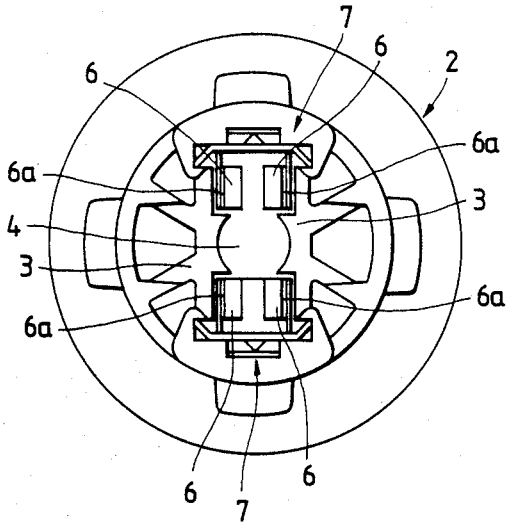
FIG. 13 is a plan view of a conventional wedge-base lamp socket.
Figure 14:
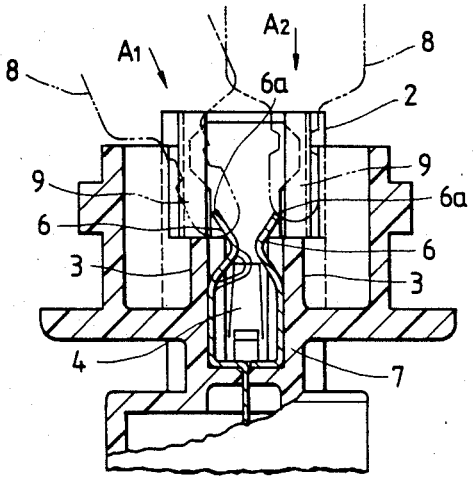
FIG. 14 is a vertical sectional view of the same.
Figure 15:
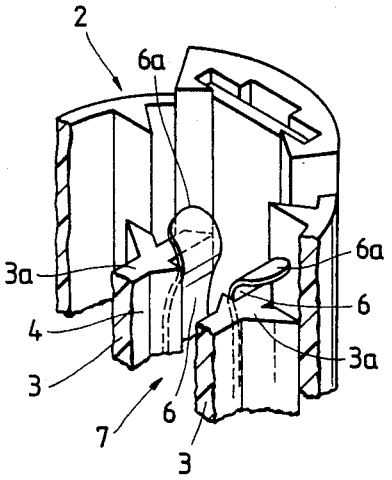
FIG. 15 is a partially-broken perspective view of a main portion of the same.

Although the top end bent portions of the contacting and sandwiching members 44 are formed so as to be lower than the upper end surfaces 14*b*$_1$ of the vertical-wall central-portion areas 14*b* in the above embodiment, the upper end surfaces 14*a* and 14*b* of vertical walls 14 may be flat with no stage as shown in FIG. 12 so long as the top end portions 44*a* are bent back to the vicinity of the walls 16. In this case, although the lamp base portion 52 can abut an area near one of the contacting and sandwiching portions 45 of the members 44 when a lamp is inserted as shown in FIG. 12, the base portion 52 slides along the bent surface of the portion 45 so as to be pressed between the opposed contacting and sandwiching members 45. Accordingly, also in this case, the lamp base portion 52 can be smoothly inserted without wrenching the contacting and sandwiching members 44.

The bend quantity of each of the contacting and sandwiching members 44 (the position of each of the top end portions 44*a*) and the projection of each of the walls 16 may be set under the condition that the inserted base portion 52 and the top end portions 44*a* of the contacting and sandwiching members do not interfere with each other. For example, with a larger projection quantity of each of the standing walls 16, the quantity of each of the top end portions 44*a* may be made correspondingly smaller. On the contrary, the larger the bend quantity of each of the top end portions 44*a*, the smaller the projection quantity of each of the standing walls 16.

As is apparent from the above description, in the wedge-base lamp socket according to this embodiment of the present invention, the walls 16 are formed projectingly and obliquely behind the contacting and sandwiching members so as to narrow the insertion path of the lamp base portion, and so as to guide the base portion of the inserted lamp between the opposed contacting and sandwiching members. Since the top end portions of the contacting and sandwiching members are located outside the base portion insertion path, the inserted base portion and the respective top end portions of the contacting and sandwiching member do not interfere with each other. According to the present invention, in inserting the lamp base portion, there is no fear that the contacting and sandwiching members will be deformed, so that the wedge-base lamp can always be smoothly inserted into the socket.

Further, the elasticity of the contacting and sandwiching members can be kept unchanged because there is no problem of wrenching and deformation or the like.

Referring to drawing FIGS. 16–21, further embodiments of the present invention will be described hereunder.

Figure 16:
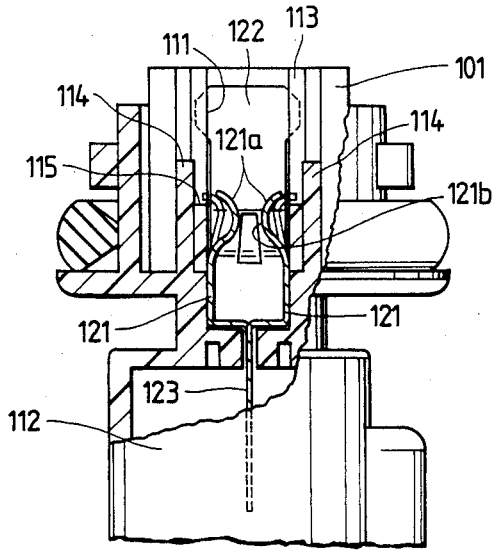
FIG. 16 is a partially cutaway front view showing a further embodiment of the wedge-base lamp socket according to the present invention.
Figure 17:
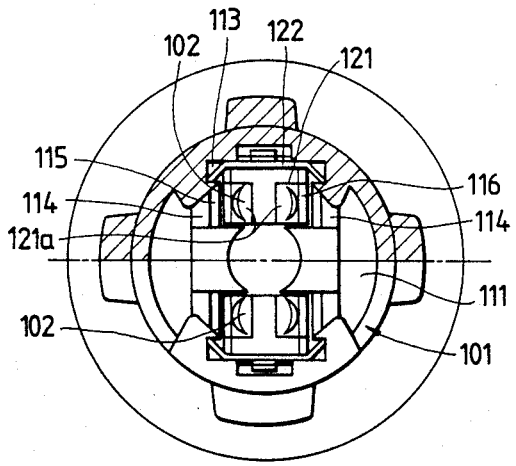
FIG. 17 is a half-sectional plan view of the same.
Figure 18:
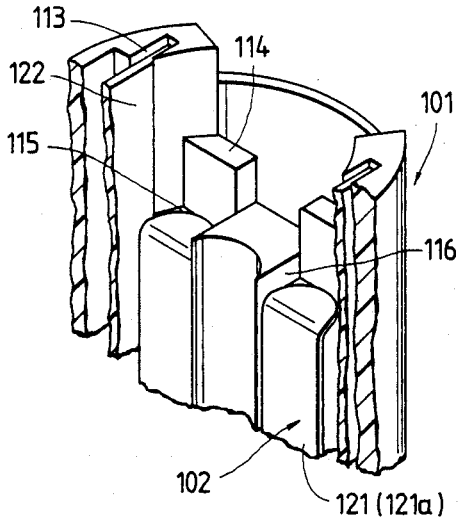
FIG. 18 is a perspective view of a main portion of the same
Figure 19:
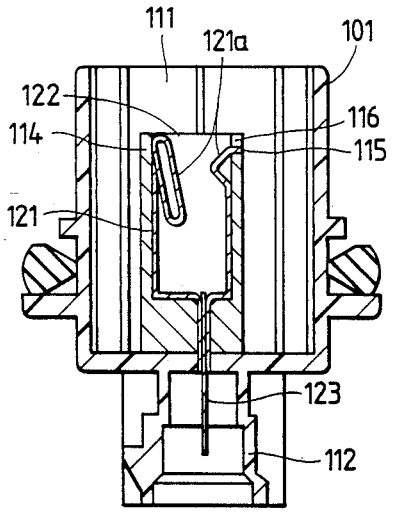
FIG. 19 is a sectional front view showing a still further embodiment of the present invention.
Figure 20:
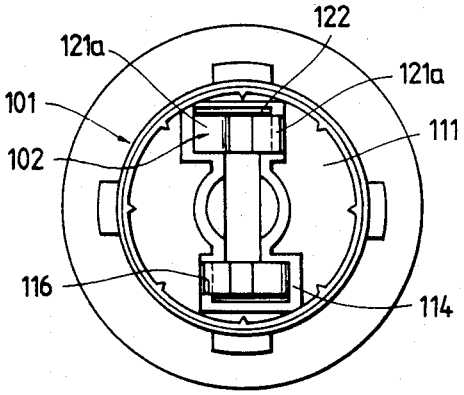
FIG. 20 is a plan view of the latter embodiment.
Figure 21:
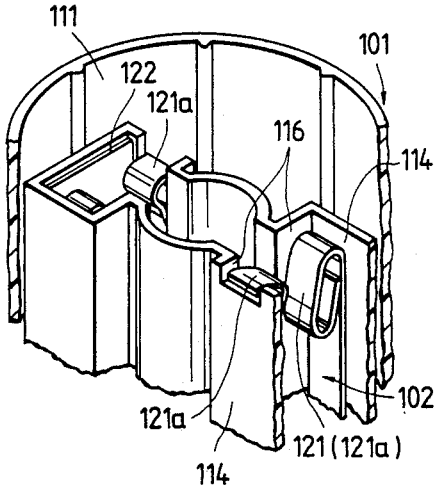
FIG. 21 is a perspective view of a main portion of the same.

In FIGS. 16–18, socket body 101 is made of an insulating material such as synthetic resin or the like so as to constitute a lamp insertion channel 111 for inserting and supporting a base portion Al of a wedge-base lamp A and a connector insertion channel 112 for inserting and supporting a connector (not shown), the channels 111 and 112 being formed integrally with each other. Two terminals (a plus terminal and an earth terminal) 102, 102 are arranged in parallel to each other in the inside of the lamp insertion channel 11, and each of the terminals 102, 102 is provided with a pair of contacting and sandwiching members 121 for sandwiching the base portion Al of the lamp A therebetween and for making electrical contact with a lead of the lamp A.

Each of the terminals 2 is made from one sheet of an electrically-conductive metal-plate material. That is, from the sheet of metal-plate material, the pair of contacting and sandwiching members 121 for sandwiching the base portion A1 of the lamp A therebetween and for making electrical connection with the lead wire of the lamp A, an attachment portion 122 to be inserted in and engaged with an attachment groove 113 of the socket body 101, and a connector-side contact portion 123 to be electrically connected to the connector (not shown) are integrally formed to constitute the terminal 102. The pair of contacting and sandwiching members 121 are bent and raised substantially perpendicularly to the attachment portion 122 so as to be able to sandwich the base portion A1 of the lamp A therebetween, and respective top end portions **121*a* of the contacting and sandwiching members 121 are outwardly bent arcuately continuously from the sandwiching portions 121*b* and 121*b*. By so forming the top end portions 121*a* of the respective contacting and sandwiching members, it is easy to lead the base portion A1 between the contacting and sandwiching members along the top end portions 121*a* when the lamp A is inserted. The possibility that the contacting and sandwiching members of the terminal may be wrenched and deformed by the base portion Al of the lamp A is thus reduced. As shown in FIGS. 4 through 6, one of the contacting and sandwiching members 121** may be inwardly curled to provide elasticity.

In the inside of the lamp insertion channel 111 of the socket, walls 114 higher than the top end portions **121*a* of the contacting and sandwiching members 121 are integrally projectingly formed behind the members 121, and deformation prevention walls 116 are integrally projectingly formed at side positions of the top end portions 121*a*. Thus, stages 115 for preventing the contacting and sandwiching members 121 from excessively opening are formed between the walls 114 and the top end portions 121*a*. In other words, the walls 114 are projectingly formed behind the top end portions 121*a* so as to be slightly separated therefrom such that the top end portions 121*a* abut the walls 114 when they are excessively opened. The deformation preventing walls 116 act to restrict the transverse (widthwise) movement of the portions 121 so as to prevent the deformation thereof, and are projectingly formed at side positions of the portions 121*a* so as to be little higher than the top end portions. That is, in the case of the embodiment shown in FIGS. 16 through 18, the top end portions are restricted as to transverse movement by the deformation preventing walls 116 and the attachment portions 122 of the terminal In the case of the embodiment shown in FIGS. 19 through 21, one top end portion 121*a* of one of the contacting and sandwiching portions 121 is restricted in its transverse movement by the deformation preventing wall 116 and the attachment portion 122 of the terminal, while the other top end portion 112*a* of the other connecting portion 121 is restricted transversely by the projected deformation preventing walls 116, 116**.

With the wedge-base lamp socket configured as described above, even if the lamp is slantingly inserted into the lamp insertion of the socket body, the base portion of the lamp abuts against walls projected behind the contacting and sandwiching members of the terminals so as to make it impossible to insert the lamp into the insertion channel, or the direction of the base portion of the lamp is corrected so that the base portion of the lamp is properly aligned and inserted. Further, the base portion of the lamp is restricted in its transverse movement by deformation preventing walls projected at the side positions of the top end portions of the contacting and sandwiching members, so that there is no possibility of the contacting and sandwiching members of the terminals being wrenched and deformed by the base portion of the lamp when the lamp is inserted.

Further, excessive opening (excessive flexible deformation) and transverse deformation of the contacting and sandwiching members can be prevented by the walls 114 and the deformation preventing walls. Accordingly, the spring property of the contacting and sandwiching members can be maintained so as to cause the contacting and sandwiching members to firmly hold the lamp therebetween.

What is claimed is:

1. A socket for a wedge-base lamp, comprising: a generally cylindrical lamp socket body formed of an insulating material; first and second conductive terminal members positioned within said socket body for sandwiching a base portion of a lamp and making contact with terminals of said lamp, each of said terminal members comprising first and second contacting and sandwiching members opposed to each other; a pair of first vertical walls opposed to each other and defining a lamp insertion channel, one of said first vertical walls being positioned between said first contracting and sandwiching members and the other of said first vertical walls being positioned between said second contacting and sandwiching member; four second vertical walls, a first pair of said second vertical walls being disposed on opposite sides of one of said first vertical walls, a second pair of said second vertical walls being disposed on opposite sides of the other of said first vertical walls, each of said second vertical walls being located behind a respective one of said contacting and sandwiching members, and a top end portion of each of said contacting and sandwiching members extending above and being bent over a top end of the respective one of said second vertical walls; and a plurality of third vertical walls, a respective one of said third vertical walls being located behind each juncture between one of said first vertical walls and a respective one of said second vertical walls, said third vertical walls extending above said top end portions of said contacting and sandwiching members by a height such that a base portion of a slantingly inserted lamp abuts against inside corner portions of said third vertical walls above said first vertical walls and is prevented from interfering with said top end portions of said contacting and sandwiching members.

2. The socket for a wedge-base lamp of claim 1, wherein said third vertical walls are substantially L-shaped in horizontal cross section extending from back portions of said first vertical walls and having base portions offset from respective ones of said second vertical walls.

3. The socket for a wedge-base lamp of claim 1, further comprising four vertical ribs joining respective ones of said third vertical walls to an inside surface of said cylindrical lamp body.

4. The socket for a wedge-base lamp of claim 1, wherein said first vertical walls extend above said second vertical walls.

5. The socket for a wedge-base lamp of claim 1, wherein top ends of said first vertical walls are substantially flush with said top ends of said second vertical walls.

6. The socket for a wedge-base lamp of claim 1, wherein inner surfaces of said first vertical walls are rounded to receive a cylindrical post portion of a lamp.

7. The socket for a wedge-base lamp of claim 1, wherein said top end portions of said sandwiching and contacting members are bent back in a substantially horizontal plane parallel to respective top ends of said second vertical walls.

8. The socket for a wedge-base lamp of claim 1, wherein said terminals members each further comprise an attachment portion extending generally perpendicular to said contacting and sandwiching portions, edge portions of said attachment portions being received in attachment grooves formed in an inner surface of said cylindrical lamp socket body.

9. The socket for a wedge-base lamp of claim 1, wherein said third vertical walls are four in number.

* * * * *